US008579606B2

(12) United States Patent
Chen et al.

(10) Patent No.: US 8,579,606 B2
(45) Date of Patent: Nov. 12, 2013

(54) FLUID TRANSPORTATION DEVICE

(75) Inventors: Shih-Chang Chen, Hsinchu (TW); Shih-Che Chiu, Hsinchu (TW); Tsung-Pat Chou, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 119 days.

(21) Appl. No.: 13/271,454

(22) Filed: Oct. 12, 2011

(65) Prior Publication Data

US 2012/0085949 A1 Apr. 12, 2012

(30) Foreign Application Priority Data

Oct. 12, 2010 (CN) ..... 2010 1 0518101

(51) Int. Cl.
*F04B 45/047* (2006.01)

(52) U.S. Cl.
USPC ..... 417/413.2; 417/571; 137/856

(58) Field of Classification Search
USPC ..... 417/413.1, 569, 571, 413.2; 310/324, 310/330; 137/856
See application file for complete search history.

(56) References Cited

U.S. PATENT DOCUMENTS

| | | | | |
|---|---|---|---|---|
| 7,299,815 | B2 * | 11/2007 | Yamanishi | 137/15.18 |
| 7,565,744 | B2 * | 7/2009 | Matsui et al. | 29/890.131 |
| 8,157,549 | B2 * | 4/2012 | Chen et al. | 417/571 |
| 2007/0071615 | A1 * | 3/2007 | Nakajima et al. | 417/397 |
| 2009/0060750 | A1 * | 3/2009 | Chen et al. | 417/26 |

* cited by examiner

*Primary Examiner* — Peter J Bertheaud
(74) *Attorney, Agent, or Firm* — Kirton McConkie; Evan R. Witt

(57) ABSTRACT

A fluid transportation device includes a valve seat, a valve cap, a valve membrane, and an actuating module. The valve seat has an outlet channel and an inlet channel. The valve cap has a tilt structure. The valve membrane has an inlet valve structure and an outlet valve structure. The actuating module has a vibration film and an actuator. When the fluid transportation device is in a non-actuation status, a pressure cavity with a gradually-increasing depth is defined. When a voltage is applied on the actuator to result in deformation of the actuator, the vibration film generates a pressure difference to push the fluid. The fluid is introduced into the inlet valve structure through the inlet channel, guided by the tilt structure of the valve cap to be flowed from the pressure cavity to the outlet valve structure, and then flowed out of the outlet channel.

3 Claims, 11 Drawing Sheets

FLUID TRANSPORTATION DEVICE

FIELD OF THE INVENTION

The present invention relates to a fluid transportation device, and more particularly to a fluid transportation device with increased flow rate and reduced instantaneous backflow.

BACKGROUND OF THE INVENTION

Nowadays, fluid transportation devices used in many sectors such as pharmaceutical industries, computer techniques, printing industries, energy industries are developed toward miniaturization. The fluid transportation devices are used in for example micro pumps, micro atomizers, printheads or industrial printers for transporting small amounts of gases or liquids. Therefore, it is important to provide an improved structure of the fluid transportation device.

FIG. 1A is a schematic front exploded view illustrating a conventional fluid transportation device. FIG. 1B is a schematic rear exploded view illustrating the conventional fluid transportation device of FIG. 1A. As shown in FIGS. 1A and 1B, the conventional fluid transportation device 1 comprises a valve seat 10, a valve membrane 11, a valve cap 12, an actuating module 13, and a cover plate 14. For assembling the conventional fluid transportation device 1, the valve membrane 11 is firstly arranged between the valve seat 10 and the valve cap 12. Then, the valve membrane 11, the valve seat 10 and the valve cap 12 are laminated together. Then, the actuating module 13 is disposed on a corresponding position of the valve cap 12. The actuating module 13 comprises a vibration film 131 and an actuator 132 for actuating the fluid transportation device 1. Afterwards, the cover plate 14 is disposed on the actuating module 13. Meanwhile, the conventional fluid transportation device 1 is assembled.

As shown in FIG. 1A, the valve seat 10 comprises an inlet channel 101 and an outlet channel 102. The ambient fluid is introduced into the inlet channel 101 and then transported to an opening 103 in a top surface of the valve seat 10. An outlet buffer cavity 104 is formed between the valve membrane 11 and the valve seat 10 for temporarily storing the fluid therein. The fluid contained in the outlet buffer cavity 104 is transported to the outlet channel 102 through another opening 105 and then exhausted out of the valve seat 10 from the outlet channel 102. Moreover, the valve membrane 11 has an inlet valve structure 111 and an outlet valve structure 112, which are respectively aligned with the opening 103 and the opening 105.

The valve cap 12 comprises an inlet valve channel 122 and an outlet valve channel 123, which are respectively aligned with the inlet valve structure 111 and the outlet valve structure 112. Moreover, an inlet buffer cavity 124 (see FIG. 1B) is formed between the valve membrane 11 and the valve cap 12. Corresponding to the actuator 132 of the actuating module 13, a pressure cavity 126 is formed in the top surface of the valve cap 12. The pressure cavity 126 is in communication with the inlet buffer cavity 124 through the inlet valve channel 122. The pressure cavity 126 is also in communication with the outlet valve channel 123.

Please refer to FIGS. 1B, 1C, 1D and 1E. A raised structure 125 is formed at the periphery of the outlet valve channel 123 corresponding to the bottom surface 121 of the valve cap 12 of the conventional fluid transportation device 1. The raised structure 125 is sustained against the outlet valve structure 112 so as to provide a pre-force to the outlet valve structure 112. When the inlet valve structure 111 is opened and the fluid is introduced within the valve cap 12 (see FIG. 1D), the volume of the pressure cavity 126 is expanded to result in suction of the valve membrane 11. Since the raised structure 125 of the valve cap 12 provides the pre-force to the outlet valve structure 112, the raised structure 125 results in a pre-sealing effect to prevent backflow. Moreover, since a negative pressure difference in the pressure cavity 126 causes a shift of the inlet valve structure 111, the fluid is flowed from the valve seat 10 into the inlet buffer cavity 124 through the inlet valve structure 111, and then transmitted to the pressure cavity 126 through the inlet buffer cavity 124 and the inlet valve channel 122. Under this circumstance, the inlet valve structure 111 is quickly opened or closed in response to the positive or negative pressure difference in the pressure cavity 126, so that the fluid is controlled to flow through the fluid transportation device without being returning back to the valve seat 10.

The valve seat 10 has another raised structure 106, which is sustained against the inlet valve structure 111. The raised structure 106 and the raised structure 125 are protruded in opposite directions. If the volume of the pressure cavity 126 is shrunken to result in an impulse (see FIG. 1E), the raised structure 106 on the top surface of the valve seat 10 will provide a pre-force to the inlet valve structure 111. The pre-force results in a pre-sealing effect to prevent backflow. Moreover, since a positive pressure difference in the pressure cavity 126 causes a shift of the outlet valve structure 112, the fluid is flowed from the pressure cavity 126 into the output buffer cavity 104 of the valve seat 10 through the valve cap 12, and exhausted out of the fluid transportation device 1 through the opening 105 and the outlet channel 102. Under this circumstance, the outlet valve structure 112 is opened to drain out the fluid contained in the pressure cavity 126 so as to transport the fluid.

In the conventional fluid transportation device 1, the actuating module 13 is enabled to expand or shrink the volume of the pressure cavity 126 to result in a pressure difference. Due to the pressure difference, the fluid is introduced into the pressure cavity 126 through the inlet valve structure 111 or ejected out of the pressure cavity 126 through the outlet valve structure 112. The way of actuating the conventional fluid transportation device 1, however, still has some drawbacks. For example, the operations of the inlet valve structure 111 and the outlet valve structure 112 are usually unstable. Especially when the inlet valve structure 111 is repeatedly actuated at the high frequency and the fluid is an irregular turbulent fluid, the regular motion of the inlet valve structure 111 is disturbed.

Moreover, since the fluid transportation is driven by expanding or shrinking the volume of the pressure cavity, the flowing efficiency is usually unsatisfied. As shown in FIG. 1D, after the fluid is introduced into the inlet valve channel 122 through the inlet valve structure 111, the fluid will be directed to the pressure cavity 126 in diverse directions. In other words, a portion of the fluid may be flowed to the position distant from the outlet. Under this circumstance, since the fluid is partially stagnant, the performance of the conventional fluid transportation device 1 is deteriorated.

Therefore, there is a need of providing a fluid transportation device for increasing the stable operations of the valve structure and enhancing the flowing efficiency in order to obviate the drawbacks encountered from the prior art.

SUMMARY OF THE INVENTION

The present invention provides a fluid transportation device having a sustaining structure and a tilt structure. The sustaining structure is only sustained against a side of the inlet valve structure, thereby limiting an opening direction and an opening degree of the inlet valve structure and permitting a stable operation of the inlet valve structure. Moreover, due to the tilt structure, a pressure cavity with a gradually-increasing depth is defined. The tilt structure and the conical outlet valve channel may facilitate guiding a great amount of fluid toward the outlet valve structure in a quick and centralized manner. Consequently, the drawbacks (e.g. the unstable operation of the valve structure, the low flowing efficiency and the deteriorated performance) of the conventional fluid transportation device will be avoided.

In accordance with an aspect of the present invention, there is provided a fluid transportation device for transporting a fluid. The fluid transportation device includes a valve seat, a valve cap, a valve membrane, and an actuating module. The valve seat has an outlet channel and an inlet channel. The valve cap is disposed on the valve seat, and has a tilt structure. The valve membrane is arranged between the valve seat and the valve cap, and has an inlet valve structure and an outlet valve structure. The actuating module is disposed on the valve cap, and includes a vibration film and an actuator. When the fluid transportation device is in a non-actuation status, the vibration film is separated from the valve cap, so that a pressure cavity with a gradually-increasing depth is defined. When a voltage is applied on the actuator to result in deformation of the actuator, the vibration film connected to the actuator causes a volume change of the pressure cavity, thereby generating a pressure difference to push the fluid. The fluid is introduced into the inlet valve structure through the inlet channel, guided by the tilt structure of the valve cap to be flowed from the pressure cavity to the outlet valve structure, and then flowed out of the outlet channel.

In accordance with another aspect of the present invention, there is provided a fluid transportation device for transporting a fluid. The fluid transportation device includes a valve seat, a valve cap, a valve membrane, and an actuating module. The valve seat has an outlet channel and an inlet channel. The valve cap is disposed on the valve seat, and includes a tilt structure, a sustaining structure, an inlet valve channel and an outlet valve channel. The outlet valve channel is a conical channel for facilitating the fluid to be flowed from the outlet valve channel to the outlet valve structure. The valve membrane is arranged between the valve seat and the valve cap, and has an inlet valve structure and an outlet valve structure. The inlet valve channel and the outlet valve channel are respectively aligned with the inlet valve structure and the outlet valve structure. A first side of the inlet valve structure is sustained against the sustaining structure. The actuating module is disposed on the valve cap, and includes a vibration film and an actuator. When the fluid transportation device is in a non-actuation status, the vibration film is separated from the valve cap, so that a pressure cavity with a gradually-increasing depth is defined. When a voltage is applied on the actuator to result in deformation of the actuator, the vibration film connected to the actuator causes a volume change of the pressure cavity, thereby generating a pressure difference to push the fluid. The fluid is introduced into the inlet valve structure through the inlet channel. The sustaining structure is sustained against the first side of the inlet valve structure, so that the inlet valve structure is tilted toward a second side and the fluid is flowed to the pressure cavity through the second side of the inlet valve structure. The fluid is further guided by the tilt structure of the valve cap to be flowed from the pressure cavity to the outlet valve structure, and then flowed out of the outlet channel.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
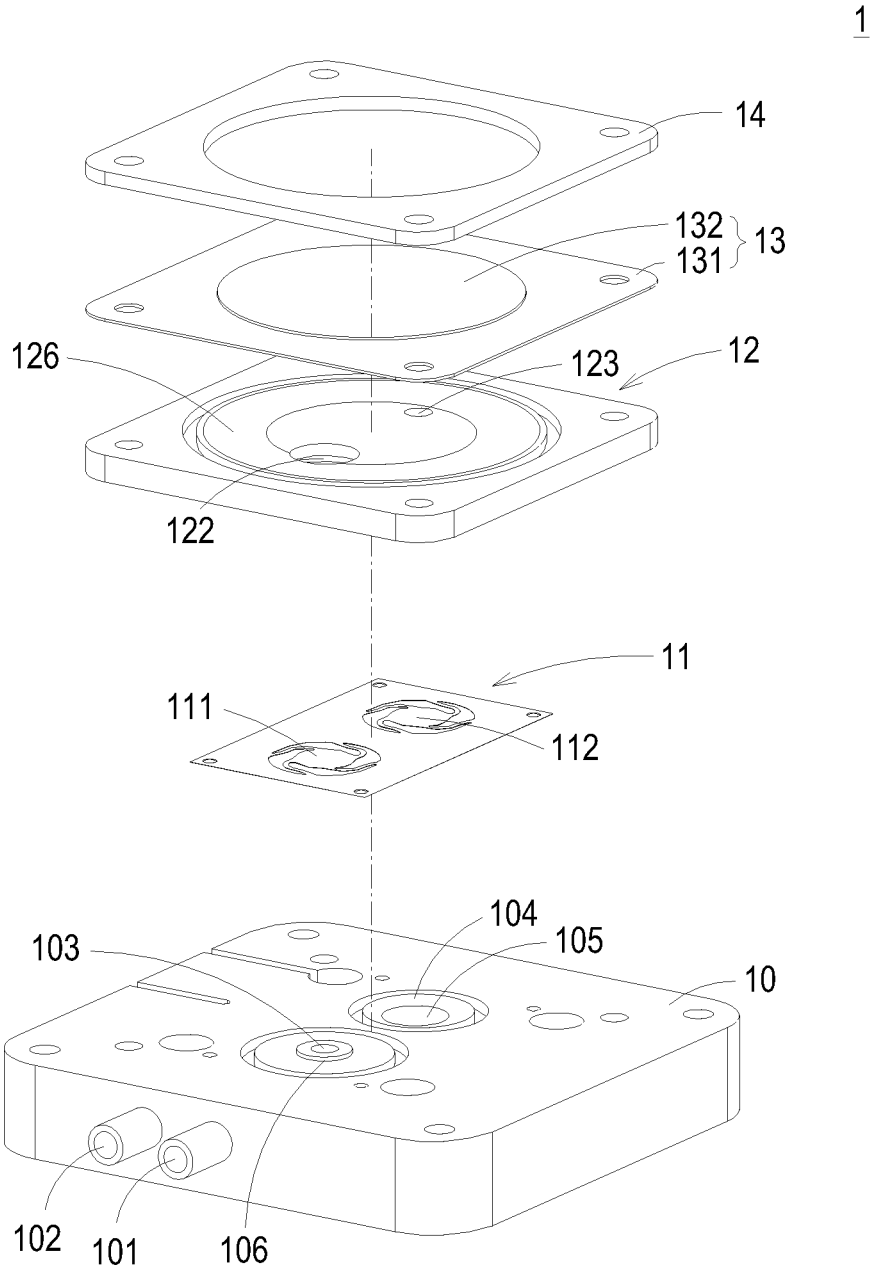
FIG. 1A PRIOR ART
FIG. 1A is a schematic front exploded view illustrating a conventional fluid transportation device.
Figure 1B:
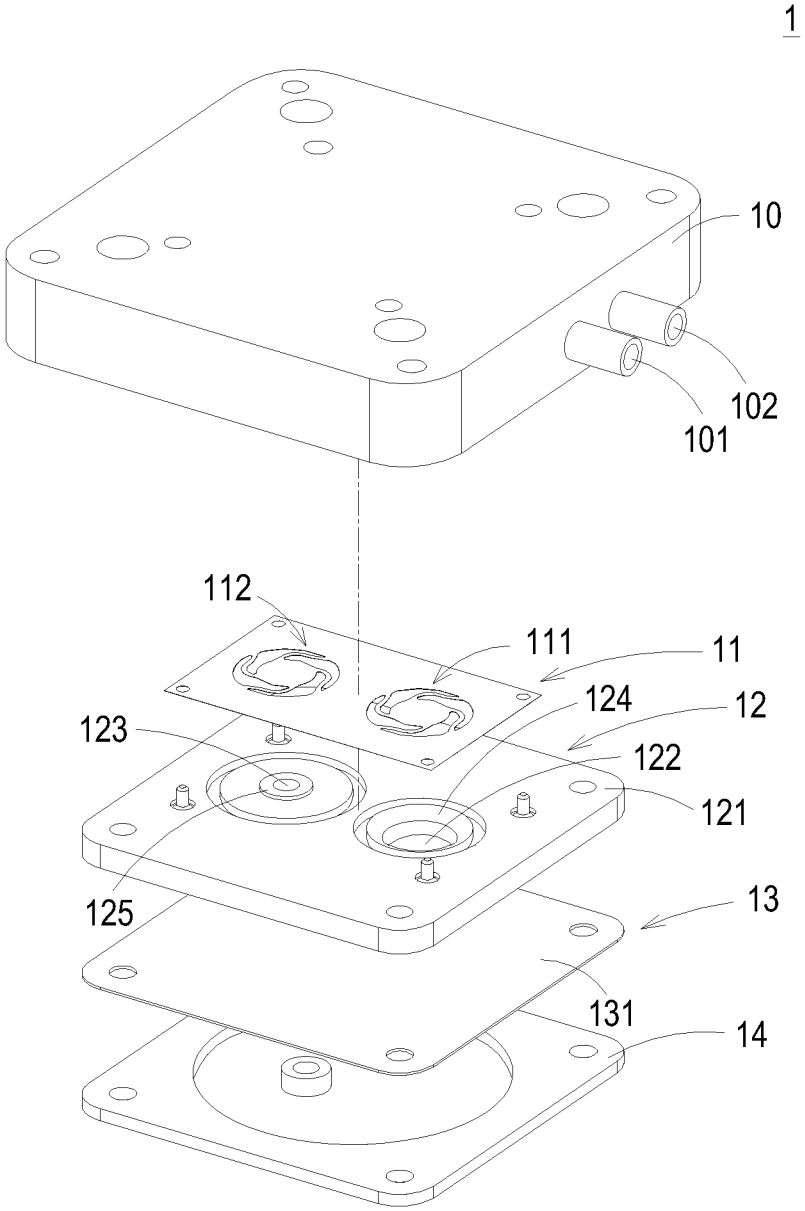
FIG. 1B PRIOR ART
FIG. 1B is a schematic rear exploded view illustrating the conventional fluid transportation device of FIG. 1A.
Figure 1C:
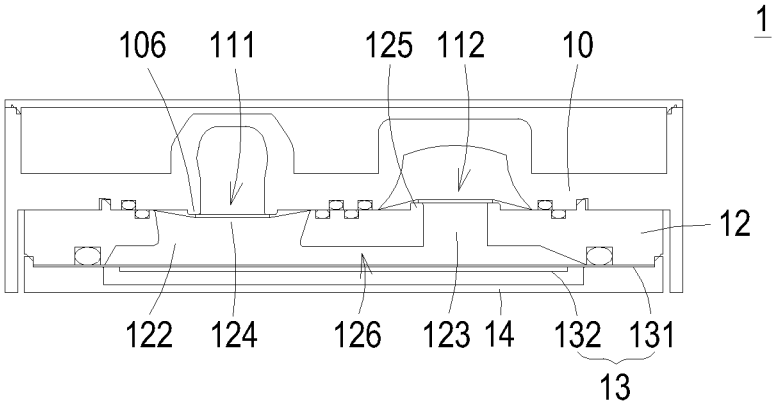
FIG. 1C PRIOR ART
FIG. 1C is a schematic cross-sectional view illustrating the conventional fluid transportation device of FIG. 1B.
Figure 1D:
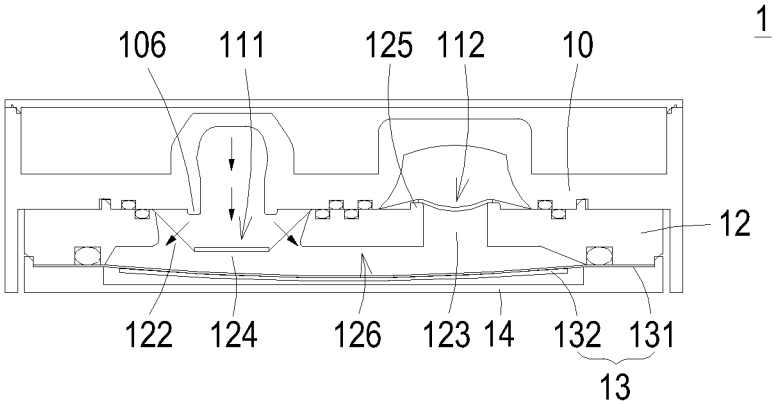
FIG. 1D PRIOR ART
FIG. 1D is a schematic cross-sectional view illustrating the conventional fluid transportation device of FIG. 1C, in which the fluid is introduced into the inlet valve structure.
Figure 1E:
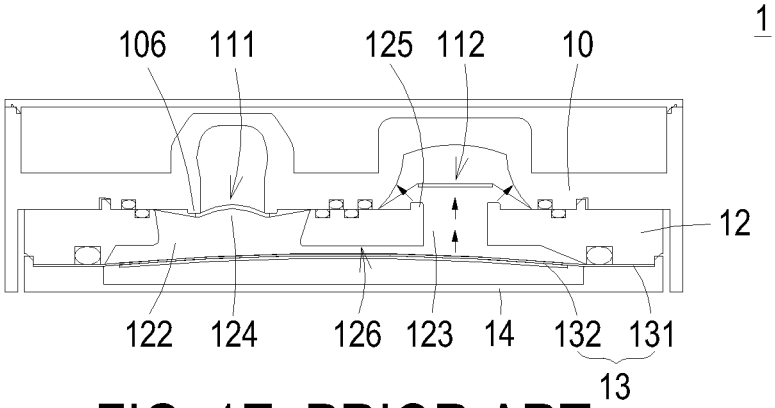
FIG. 1E PRIOR ART
FIG. 1E is a schematic cross-sectional view illustrating the conventional fluid transportation device of FIG. 1C, in which the fluid is flowed out of the outlet valve structure.
Figure 2A:
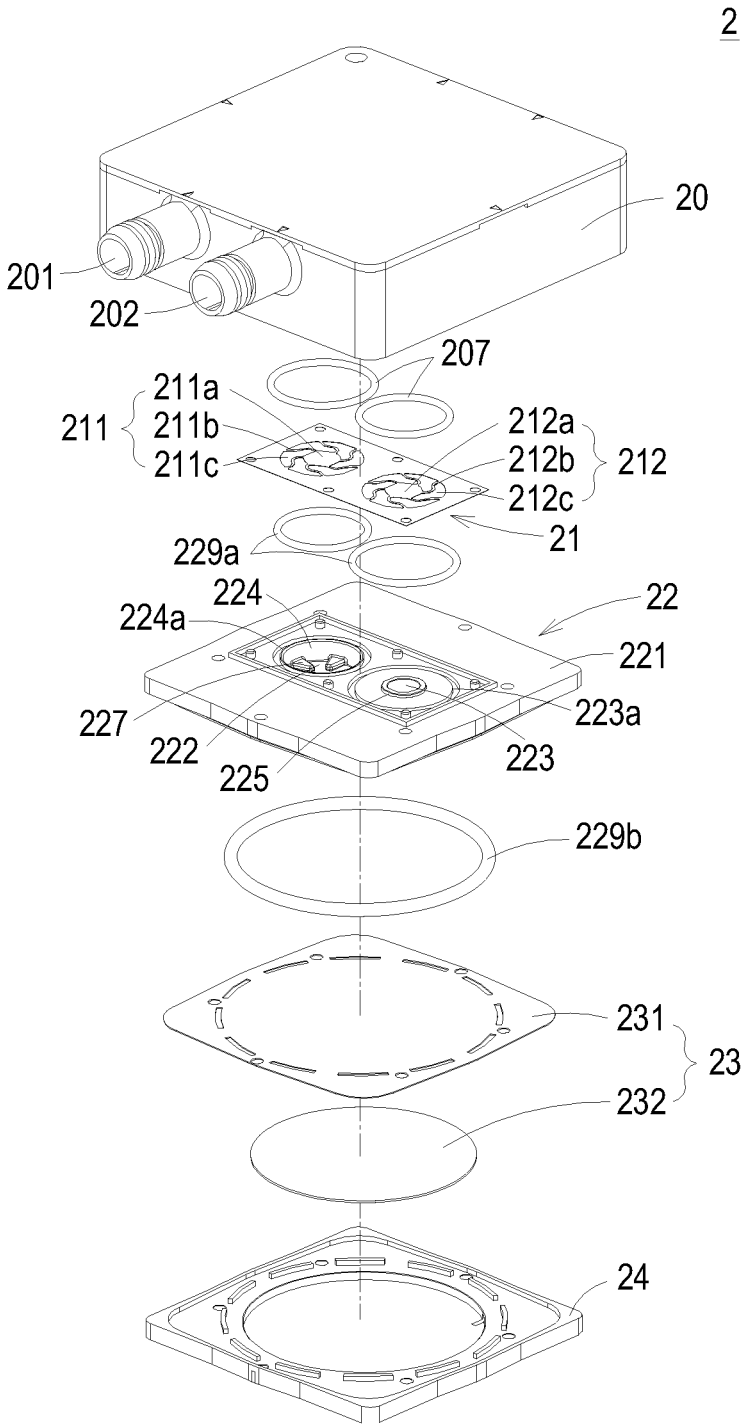
FIG. 2A is a schematic rear exploded view illustrating a fluid transportation device according to a first embodiment of the present invention.

FIG. 2A is a schematic rear exploded view illustrating a fluid transportation device according to a first embodiment of the present invention. As shown in FIG. 2A, the fluid transportation device 2 comprises a valve seat 20, a valve membrane 21, a valve cap 22, an actuating module 23, and a cover plate 24. For assembling the conventional fluid transportation device 2, the valve membrane 21 is firstly arranged between the valve seat 20 and the valve cap 22. Then, the valve membrane 21, the valve seat 20 and the valve cap 22 are laminated together. Then, the actuating module 23 is disposed on a corresponding position of the valve cap 22. The actuating module 23 comprises a vibration film 231 and an actuator 232 for actuating the fluid transportation device 2. When the fluid transportation device 2 is in a non-actuation status, the vibration film 231 is separated from the valve cap 22, so that a pressure cavity 226 with a gradually-increasing depth is defined (see FIG. 3A). Afterwards, the cover plate 24 is combined with the actuating module 23, the valve cap 22 and the valve seat 20, thereby assembling the fluid transportation device 2.

As shown in FIG. 2A, the valve seat 20 comprises an inlet channel 201 and an outlet channel 202. The ambient fluid is introduced into the inlet channel 201 and then transported to an opening 203 of the valve seat 20 (see FIG. 3B). An outlet buffer cavity 204 (see FIG. 3A) is formed between the valve membrane 21 and the valve seat 20 for temporarily storing the fluid therein. The fluid contained in the outlet buffer cavity 204 is transported to the outlet channel 202 through another opening 205 and then exhausted out of the valve seat 20 from the outlet channel 202.

The valve membrane 21 is a sheet-like membrane with substantially uniform thickness. Moreover, the valve membrane 21 comprises a plurality of hollow-types valve switches (e.g. first and second valve switches). In this embodiment, the first valve switch is an inlet valve structure 211, and the second valve switch is an outlet valve structure 212. The inlet valve structure 211 comprises an inlet valve slice 211*a* and several perforations 211*b*. The perforations 211*b* are formed in the periphery of the inlet valve slice 211*a*. In addition, the inlet valve structure 211 has several extension parts 211*c* between the inlet valve slice 211*a* and the perforations 211*b*. Similarly, the outlet valve structure 212 comprises an outlet valve slice 212*a*, several perforations 212*b* and several extension parts 212*c*. The perforations 212*b* are formed in the periphery of the outlet valve slice 212*a*. The extension parts 212*c* are arranged between the outlet valve slice 212*a* and the perforations 212*b*.

The valve cap 22 comprises an inlet valve channel 222 and an outlet valve channel 223, which are respectively aligned with the inlet valve structure 211 and the outlet valve structure 212. Moreover, an inlet buffer cavity 224 is formed between the valve membrane 21 and the valve cap 22. A raised structure 225 is formed at the periphery of the outlet valve channel 223. The raised structure 225 is sustained against the outlet valve slice 212*a* of the outlet valve structure 212 so as to provide a pre-force to the outlet valve slice 212*a* (see FIG. 3A). Corresponding to the actuator 232 of the actuating module 23, a pressure cavity 226 is formed in a surface of the valve cap 22. The pressure cavity 226 is in communication with the inlet buffer cavity 224 through the inlet valve channel 222. The pressure cavity 226 is also in communication with the outlet valve channel 223.

Moreover, the valve seat 20 has a plurality of recesses (not shown) for accommodating the sealing rings 207. When the sealing rings 207 are accommodated within the recesses, the valve seat 20 and the valve membrane 21 are in close contact with each other to prevent fluid leakage. Similarly, the valve cap 22 has a plurality of recesses. In this embodiment, the surface 221 of the valve cap 22 has recesses 224*a* and 223*a* for accommodating the sealing rings 229*a*. The recess 224*a* is located around the inlet buffer cavity 224. The recess 223*a* is located around the outlet valve channel 223. When the sealing rings 229*a* are accommodated within the recesses 223*a* and 224*a*, the valve cap 22 and the valve membrane 21 are in close contact with each other to prevent fluid leakage. Of course, another surface of the valve cap 22 has a recess (not shown), which is located around the pressure cavity 226. When the sealing ring 229*b* is accommodated within the recess, the vibration film 231 of the actuating module 23 and the valve cap 22 are in close contact with each other to prevent fluid leakage.

Figure 2B:
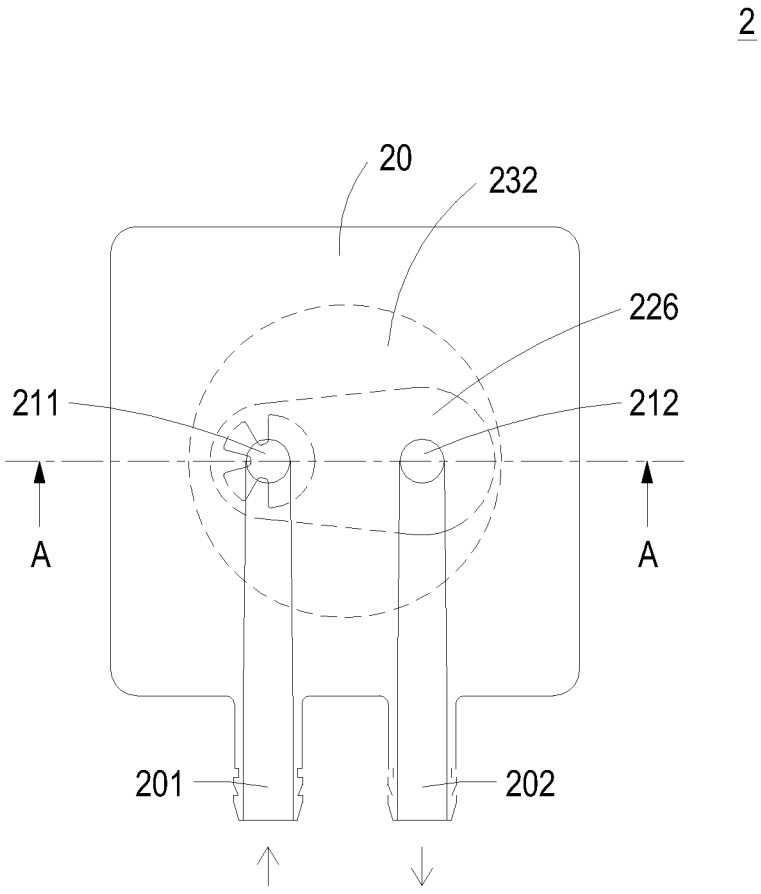
FIG. 2B is a schematic top view illustrating the fluid transportation device of FIG. 2A.
Figure 2C:
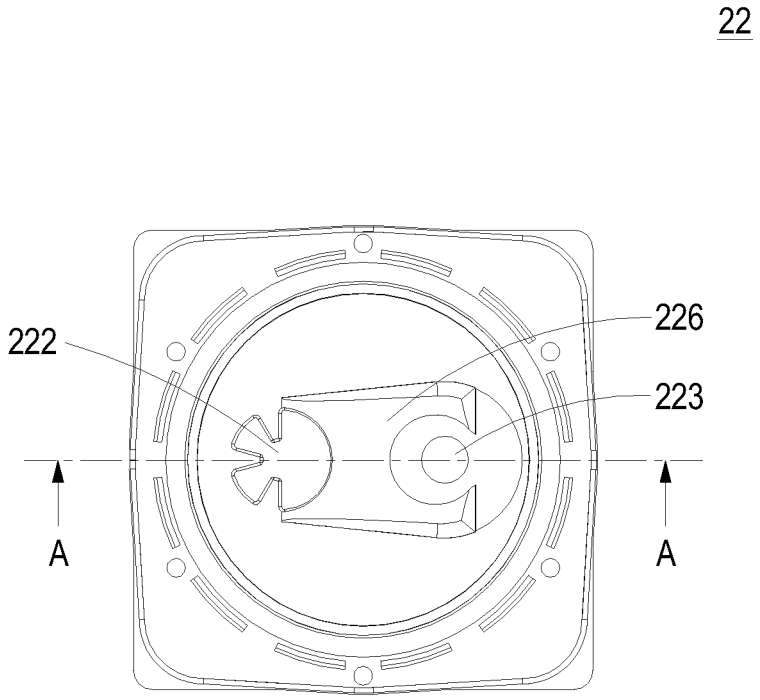
FIG. 2C is a schematic top view illustrating the valve cap of the fluid transportation device of FIG. 2A.

FIG. 2B is a schematic top view illustrating the fluid transportation device of FIG. 2A. FIG. 2C is a schematic top view illustrating the valve cap of the fluid transportation device of FIG. 2A. As shown in FIG. 2B, the inlet channel 201 and the outlet channel 202 are located at the same side of the valve seat 20. In addition, the inlet channel 201 is in communication with the inlet valve structure 211. The outlet channel 202 is in communication with the outlet valve structure 212. In a case that a voltage is applied to the actuator 232 of the actuating module 23 to result in deformation of the actuator 232, the vibration film 231 connected with the actuator 232 will cause a volume change of the pressure cavity 226. Due to the volume change, a pressure difference is generated to push the fluid. Consequently, the fluid is introduced into the inlet valve structure 211 through the inlet channel 201, then flowed into the pressure cavity 226, and finally flowed to the outlet channel 202 through the outlet valve structure 212. In such way, the purpose of transporting the fluid is achieved.

In this embodiment, the pressure cavity 226 has a gradually-increasing depth. As shown in FIGS. 2B and 2C, the pressure cavity 226 has an arc-shaped profile. That is, a first portion of the pressure cavity 226 near the inlet valve channel 222 is shallower, and a second portion of the pressure cavity 226 near the outlet valve channel 223 is deeper. In this embodiment, the pressure cavity 226 with the gradually-increasing depth is defined by a tilt structure 228 (see FIG. 3A). The tilt structure 228 is arranged between the inlet valve channel 222 and the outlet valve channel 223. Due to the tilt structure 228, the depth of the pressure cavity 226 between the inlet valve channel 222 and the outlet valve channel 223 is non-uniformly distributed. That is, the fluid within the pressure cavity 226 may be guided by the tilt structure 228 to be flowed from the inlet valve channel 222 to the outlet valve channel 223.

Figure 3A:
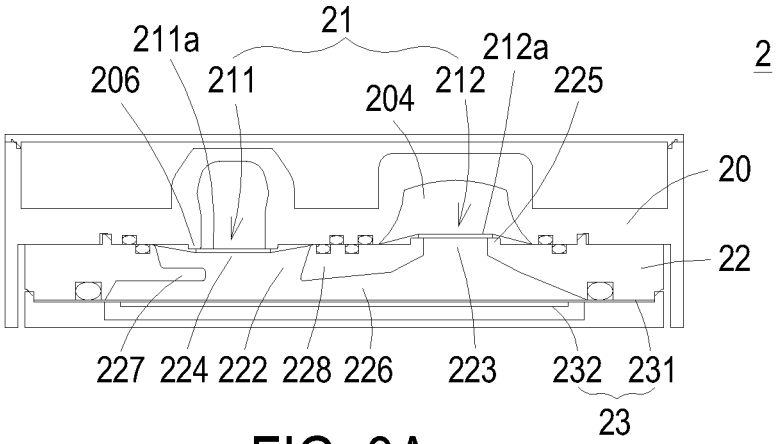
FIG. 3A is a schematic cross-sectional view illustrating the fluid transportation device of FIG. 2B and taken along the line AA.
Figure 3B:
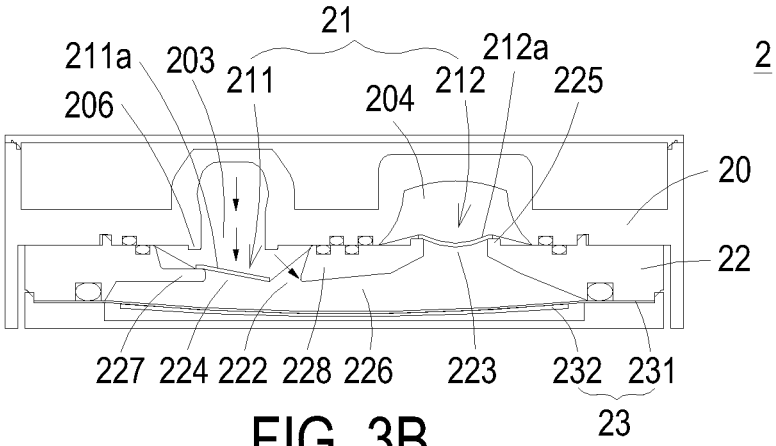
FIG. 3B is a schematic cross-sectional view illustrating the fluid transportation device of FIG. 3A, in which the fluid is introduced into the inlet valve structure.
Figure 3C:
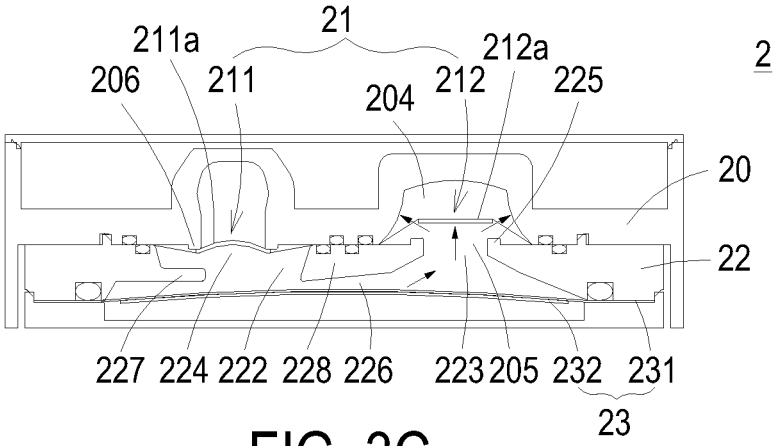
FIG. 3C is a schematic cross-sectional view illustrating the fluid transportation device of FIG. 3A, in which the fluid is flowed out of the outlet valve structure.

Please refer to FIGS. 3A, 3B and 3C. FIG. 3A is a schematic cross-sectional view illustrating the fluid transportation device of FIG. 2B and taken along the line AA. FIG. 3B is a schematic cross-sectional view illustrating the fluid transportation device of FIG. 3A, in which the fluid is introduced into the inlet valve structure. FIG. 3C is a schematic cross-sectional view illustrating the fluid transportation device of FIG. 3A, in which the fluid is flowed out of the outlet valve structure.

As shown in FIG. 3A, the fluid transportation device 2 further comprises a sustaining structure 227 for facilitating fluid transportation. The sustaining structure 227 is located beside the inlet valve channel 222 of the valve cap 22. When the fluid is introduced from the valve seat 20 into the inlet buffer cavity 224 of the valve cap 22 through the inlet valve structure 211, as shown in FIG. 3B, the sustaining structure 227 is sustained against a side of the inlet valve slice 211*a*. Meanwhile, the inlet valve slice 211*a* is tilted toward the other side which is not sustained against and stopped by the sustaining structure 227. Consequently, the fluid is flowed out through the perforations 211*b* at the periphery of the non-stopped side of the inlet valve slice 211*a*. Since the sustaining structure 227 is sustained against the inlet valve slice 211*a* and the inlet valve slice 211*a* is tilted, the inlet valve structure 211 has different opening degrees for guiding the fluid to be flowed through the non-sustained side of the inlet valve slice 211*a*. In other words, the fluid can be transported along a shorter path relative to the outlet valve structure 212. In comparison with the conventional fluid transportation device 1, the inlet valve structure 211 of the fluid transportation device 2 is sustained against the sustaining structure 227. Consequently, once the inlet valve structure 211 is opened, only one side of the inlet valve structure 211 is opened. Since the side of the inlet valve structure 311 near the outlet valve structure 212 has a larger opening degree, a great amount of fluid can be quickly introduced into the pressure cavity 226 through the inlet valve structure 211. Moreover, the fluid can be transported to the outlet valve structure 212 along a shorter path relative to the outlet valve structure 212. Moreover, since the inlet valve structure 211 of the fluid transportation device 2 is only opened to the outlet valve structure 212, the possibility of causing the stagnant fluid will be minimized. Moreover, when the inlet valve structure 211 is repeatedly actuated at the high frequency, the sustaining structure 227 of the fluid transportation device 2 can reduce the possibility of disturbing the regular motion of the inlet valve structure 211 by the irregular turbulent fluid.

In some embodiments, the outlet valve channel 223 is a conical channel. As shown in FIGS. 3A, 3B and 3C, the outlet valve channel 223 has a funnel-like conical shape with a wide bottom part and a narrow top part. Due to the conical outlet valve channel 223, the fluid in the pressure cavity 226 can be collected, received and guided to the narrow part of the outlet valve structure 212. In such way, the flow rate of the fluid transportation device 2 will be increased.

Please refer to FIGS. 3B and 3C again. In a case that the actuator 232 is subject to the downward deformation due to a voltage applied thereon, the volume of the pressure cavity 226 is expanded to result in suction. Due to the suction, the inlet valve slice 211*a* of the inlet valve structure 211 possessing the pre-force is quickly opened and tilted toward the outlet side. Consequently, a great amount of fluid is introduced into the inlet channel 201 of the valve seat 20, then transported through the perforations 211*b* of the outlet side of the inlet valve structure 211 of the valve membrane 21, the inlet buffer cavity 224 and the inlet valve channel 222 of the valve cap 22, and flowed into the pressure cavity 226 with the gradually-increasing depth. Moreover, when the volume of the pressure cavity 226 is expanded to result in suction, since the raised structure 225 of the valve cap 22 provides the pre-force to the outlet valve structure 212 of the valve membrane 21, a pre-sealing effect is generated to prevent backflow.

When the electric field is changed and the actuator 23 is subject to the upward deformation, as shown in FIG. 3C, the volume of the pressure cavity 226 with the gradually-increasing depth is shrunken to exert an impulse on the fluid in the pressure cavity 226. Due to the impulse exerted on the inlet valve structure 211 and the outlet valve structure 212 of the valve membrane 21, the outlet valve slice 212*a* of the outlet valve structure 212 over the raised structure 225 will be quickly opened and a great amount of fluid will be instantaneously ejected out. Moreover, since the fluid is guided by the pressure cavity 226 with the gradually-increasing depth, the fluid will be transported through the outlet valve channel 223, the perforations 212*b* of the outlet valve structure 212 of the valve membrane 21 and the outlet buffer cavity 204 of the valve seat 20, and flowed out of the outlet channel 202. Similarly, since the impulse is also exerted on the inlet valve structure 211, the whole inlet valve structure 211 is pressed down to lie flat on the valve seat 20. Meanwhile, the inlet valve slice 211*a* is in close contact with the raised structure 206 of the valve seat 20, so that the opening 203 of the valve seat 20 is sealed by the raised structure 206. At the same time, the perforations 211*b* at the periphery of the inlet valve slice 212*a* and the extension parts 211*c* are floated over the valve seat 20. Under this circumstance, the inlet valve structure 211 is closed, and thus no fluid can be flowed out.

From the above discussions, during operations of the actuator 23, the volume of the pressure cavity 226 with the gradually-increasing depth is expanded or shrunken to drive the fluid transportation. Consequently, a great amount of fluid is introduced into the pressure cavity 226 through the inlet valve structure 211 with a tilted side. Due to the gradually-increasing depth of the pressure cavity 226, the fluid is guided to the outlet valve structure 212, and flowed out of the valve cap 22 through the outlet valve structure 212. Moreover, the sealing rings 207, 229*a* and 229*b* of the fluid transportation device 2 can effectively prevent fluid leakage. Due to the sustaining structure 227 within the pressure cavity 226 and the tilt structure 228, the operation of the inlet valve structure 211 is more stable and more regular. Consequently, the fluid can be effectively guided to be transported along a shorter path relative to the outlet, and the instantaneous backflow will be reduced. In comparison with the conventional fluid transportation device, the fluid transportation device 2 of the present invention can result in more stable operation and higher performance.

Figure 4A:
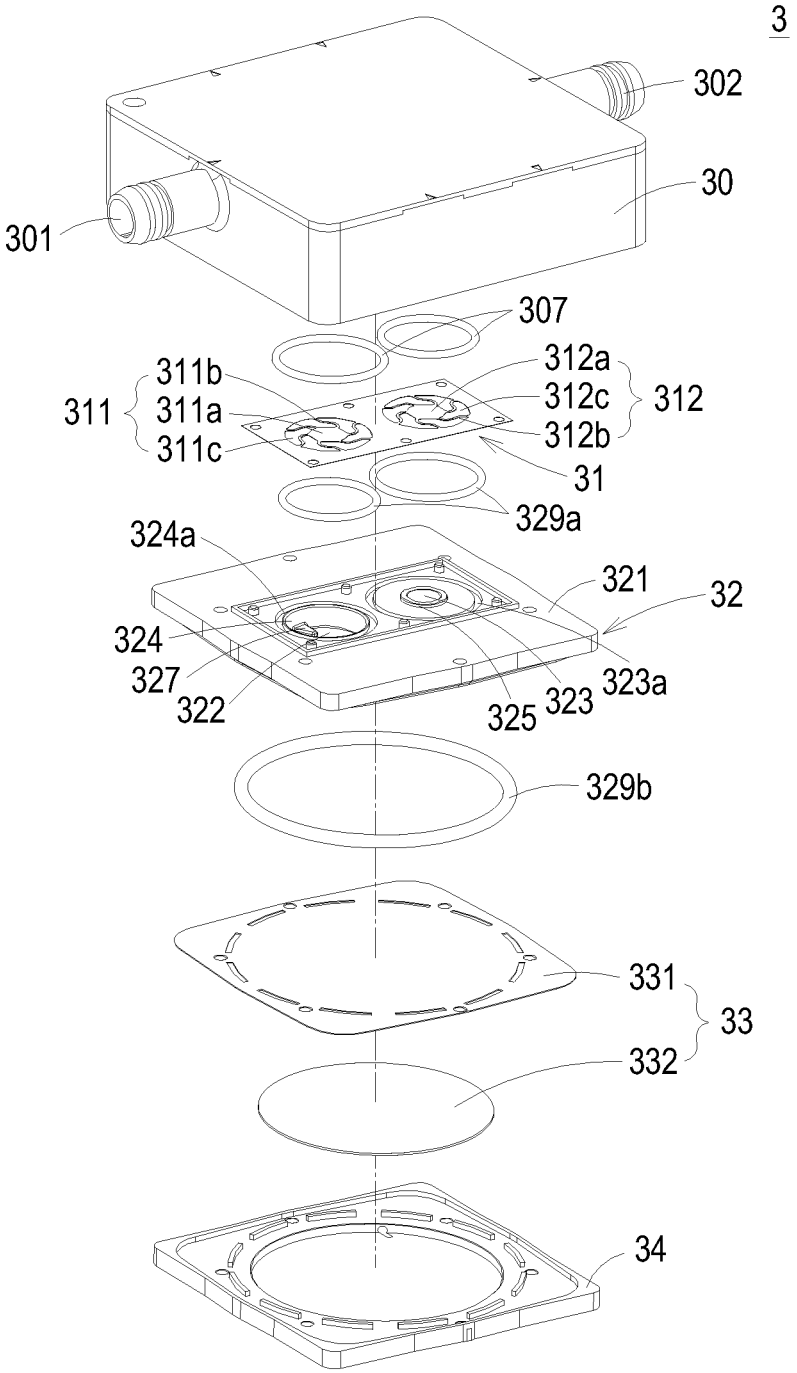
FIG. 4A is a schematic rear exploded view illustrating a fluid transportation device according to a second embodiment of the present invention.

FIG. 4A is a schematic rear exploded view illustrating a fluid transportation device according to a second embodiment of the present invention. As shown in FIG. 4A, the fluid transportation device 3 comprises a valve seat 30, a valve membrane 31, a valve cap 32, an actuating module 33, and a cover plate 34. The valve seat 30 has an inlet channel 301 and an output channel 302. The valve membrane 31 has an inlet valve structure 311 and an outlet valve structure 312. The inlet valve structure 311 comprises an inlet valve slice 311*a*, several perforations 311*b*, and several extension parts 311*c*. The outlet valve structure 312 comprises an outlet valve slice 312*a*, several perforations 312*b* and several extension parts 312*c*. The valve cap 32 has a surface 321, an inlet valve channel 322, an outlet valve channel 323, an inlet buffer cavity 324, a raised structure 325, a pressure cavity 326 (see FIG. 4B), a sustaining structure 327, and a tilt structure 328 (see FIG. 5A). The actuating module 33 comprises a vibration film 331 and an actuator 332. There are some recesses between the valve seat 30, the valve membrane 31 and the buffer cavities of the valve cap 32. For example, the recess 324*a* is located around the inlet buffer cavity 324, and the recess 323*a* is located around the outlet valve channel 323. The recesses 324*a* and 323*a* are used for accommodating corresponding sealing rings 329*a*. The recesses of the valve seat 30 are used for accommodating corresponding sealing rings 307. Another surface of the valve cap 32 has a recess (not shown) for accommodating the sealing ring 329*b*. Since the sealing rings are accommodated with corresponding recesses, the peripheries of the buffer cavities can be effectively sealed.

Figure 4B:
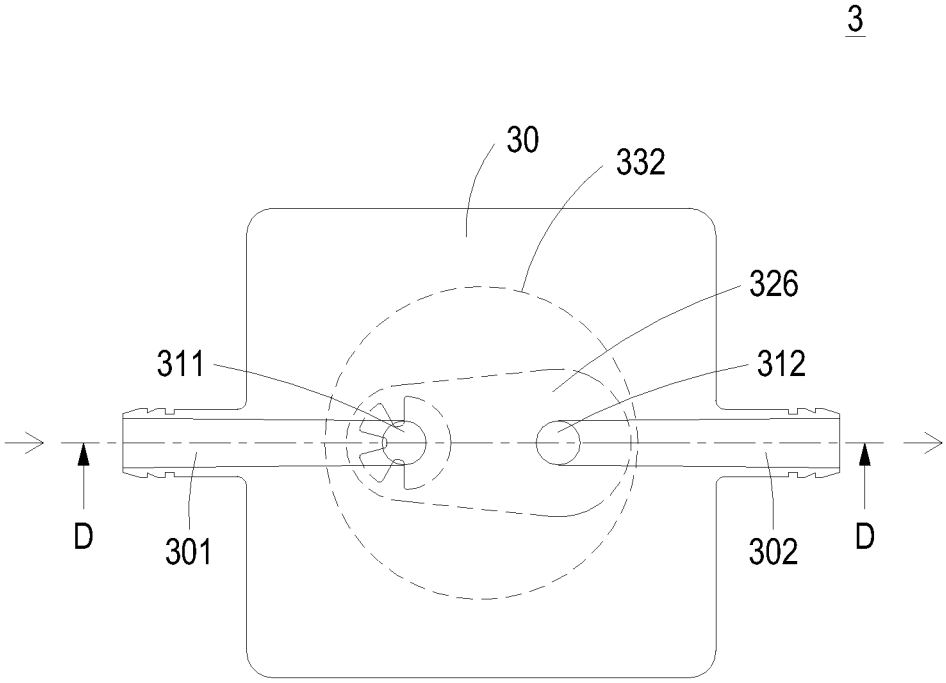
FIG. 4B is a schematic top view illustrating the fluid transportation device of FIG. 4A.

Except for the following items, the configurations and assembling processes of the valve seat 30, the valve membrane 31, the valve cap 32, the actuating module 33 and the cover plate 34 are similar to those of the first embodiment, and are not redundantly described herein. In this embodiment, as shown in FIGS. 4A and 4B, the inlet channel 301 and the output channel 302 are located at different sides of the valve seat 30. Moreover, the inlet channel 301 and the output channel 302 are aligned with each other. In addition, the inlet channel 301 is in communication with the inlet valve structure 311. The outlet channel 302 is in communication with the outlet valve structure 312. After the fluid is introduced into the pressure cavity 326 through the inlet channel 301 and the inlet valve structure 311, the operation of the actuating member 33 will drive the fluid transportation. Consequently, the fluid is flowed from the outlet valve structure 312 to the outlet channel 302.

Please refer to FIGS. 4B, 5A, 5B and 5C. In this embodiment, the pressure cavity 326 has a gradually-increasing depth. As shown in FIG. 4B, the pressure cavity 326 has an arc-shaped profile. That is, a first portion of the pressure cavity 326 near the inlet valve channel 322 is shallower (see FIG. 5A), and a second portion of the pressure cavity 326 near the outlet valve channel 323 is deeper. In this embodiment, the pressure cavity 326 with the gradually-increasing depth is defined by a tilt structure 328. The tilt structure 328 is arranged between the inlet valve channel 322 and the outlet valve channel 323. Due to the tilt structure 328, the depth of the pressure cavity 326 between the inlet valve channel 322 and the outlet valve channel 323 is non-uniformly distributed. That is, the fluid within the pressure cavity 326 may be guided by the tilt structure 328 to be flowed from the inlet valve channel 322 to the outlet valve channel 323.

Figure 5A:
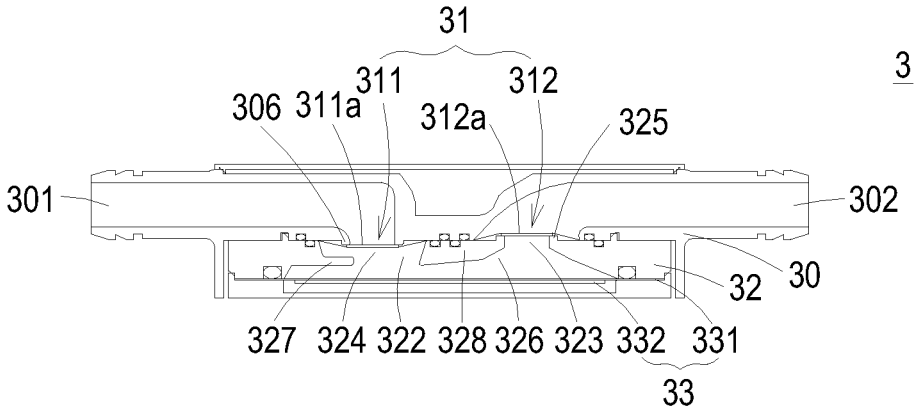
FIG. 5A is a schematic cross-sectional view illustrating the fluid transportation device of FIG. 4B and taken along the line DD.
Figure 5B:
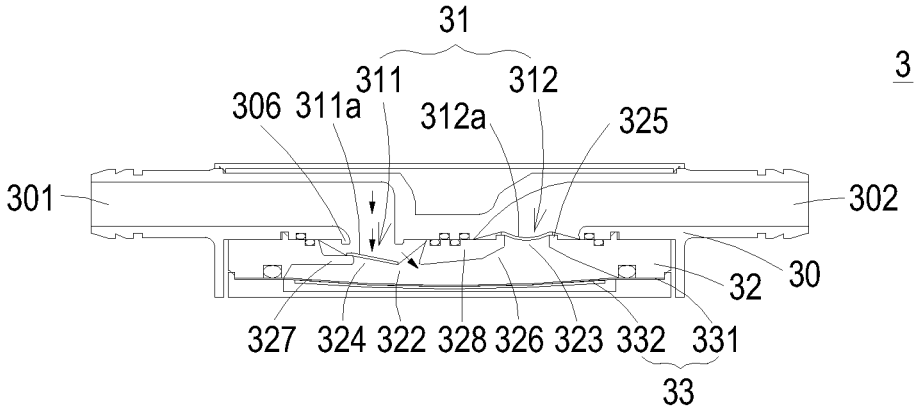
FIG. 5B is a schematic cross-sectional view illustrating the fluid transportation device of FIG. 5A, in which the fluid is introduced into the inlet valve structure.

Moreover, the valve cap 32 further comprises a sustaining structure 327. The sustaining structure 327 is located beside the inlet valve channel 322 of the valve cap 32. When the fluid is introduced from the valve seat 30 into the inlet buffer cavity 324 of the valve cap 32 through the inlet valve structure 311, as shown in FIG. 5B, the sustaining structure 327 is sustained against a side of the inlet valve slice 311*a*. Meanwhile, the inlet valve slice 311*a* is tilted toward the other side which is not sustained against and stopped by the sustaining structure 327. Consequently, the fluid is flowed out through the perforations 311*b* at the periphery of the non-stopped side of the inlet valve slice 311*a*. Since the sustaining structure 327 is sustained against the inlet valve slice 311*a* and the inlet valve slice 311*a* is tilted, the inlet valve structure 311 has different opening degrees for guiding the fluid to be flowed through the non-sustained side of the inlet valve slice 311*a*. Moreover, since the side of the inlet valve structure 311 near the outlet valve structure 312 has a larger opening degree, a great amount of fluid can be quickly introduced into the pressure cavity 326 through the inlet valve structure 311. Moreover, the fluid can be transported to the outlet valve structure 312 along a shorter path relative to the outlet valve structure 312. Moreover, when the inlet valve structure 311 is repeatedly actuated at the high frequency, the sustaining structure 327 of the fluid transportation device 3 can reduce the possibility of disturbing the regular motion of the inlet valve structure 311 by the irregular turbulent fluid. Moreover, since the inlet valve structure 311 of the fluid transportation device 3 is only opened to the outlet valve structure 312, the possibility of causing the stagnant fluid will be minimized.

Figure 5C:
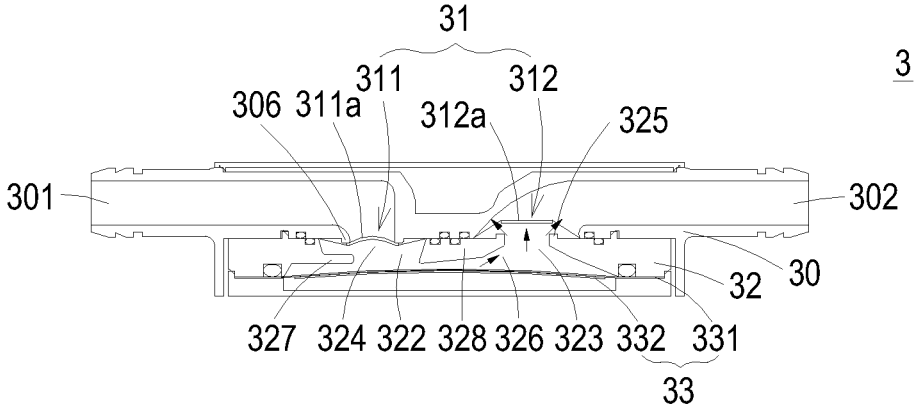
FIG. 5C is a schematic cross-sectional view illustrating the fluid transportation device of FIG. 5A, in which the fluid is flowed out of the outlet valve structure.

Similarly, the outlet valve channel 323 is a conical channel. As shown in FIGS. 5A, 5B and 5C, the outlet valve channel 323 has a funnel-like conical shape with a wide bottom part and a narrow top part. Due to the conical outlet valve channel 323, the fluid in the pressure cavity 326 can be collected, received and guided to the narrow part of the outlet valve structure 312. In such way, the flow rate of the fluid transportation device 3 will be increased.

Please refer to FIGS. 5B and 5C again. In a case that the actuator 332 is subject to the downward deformation due to a voltage applied thereon, as shown in FIG. 5B, the volume of the pressure cavity 326 is expanded to result in suction. Due to the suction, the inlet valve structure 311 possessing the pre-force is quickly opened and tilted toward the outlet side. Consequently, a great amount of fluid is introduced into the inlet channel 301, then transported through the inlet valve structure 311, the inlet buffer cavity 324 and the inlet valve channel 322, and flowed into the pressure cavity 326 with the gradually-increasing depth. Moreover, when the volume of the pressure cavity 326 is expanded to result in suction, since the raised structure 325 of the valve cap 32 provides the pre-force to the outlet valve structure 312, a pre-sealing effect is generated to prevent backflow.

When the electric field is changed and the actuator 33 is subject to the upward deformation, as shown in FIG. 5C, the volume of the pressure cavity 326 with the gradually-increasing depth is shrunken to exert an impulse on the fluid in the pressure cavity 326. Due to the impulse exerted on the inlet valve structure 311 and the outlet valve structure 312 of the valve membrane 31, the outlet valve slice 312*a* of the outlet valve structure 312 over the raised structure 325 will be quickly opened and a great amount of fluid will be instantaneously ejected out. Moreover, since the fluid is guided by the pressure cavity 326 with the gradually-increasing depth, the fluid will be transported through the outlet valve channel 323, the outlet valve structure 312 and the outlet buffer cavity 304, and flowed out of the outlet channel 302. Similarly, since the impulse is also exerted on the inlet valve structure 311, the whole inlet valve structure 311 is pressed down to lie flat on the valve seat 30. Meanwhile, the inlet valve slice 311*a* is in close contact with the raised structure 306. Under this circumstance, the inlet valve structure 311 is closed, and thus no fluid can be flowed out.

Figure 6:
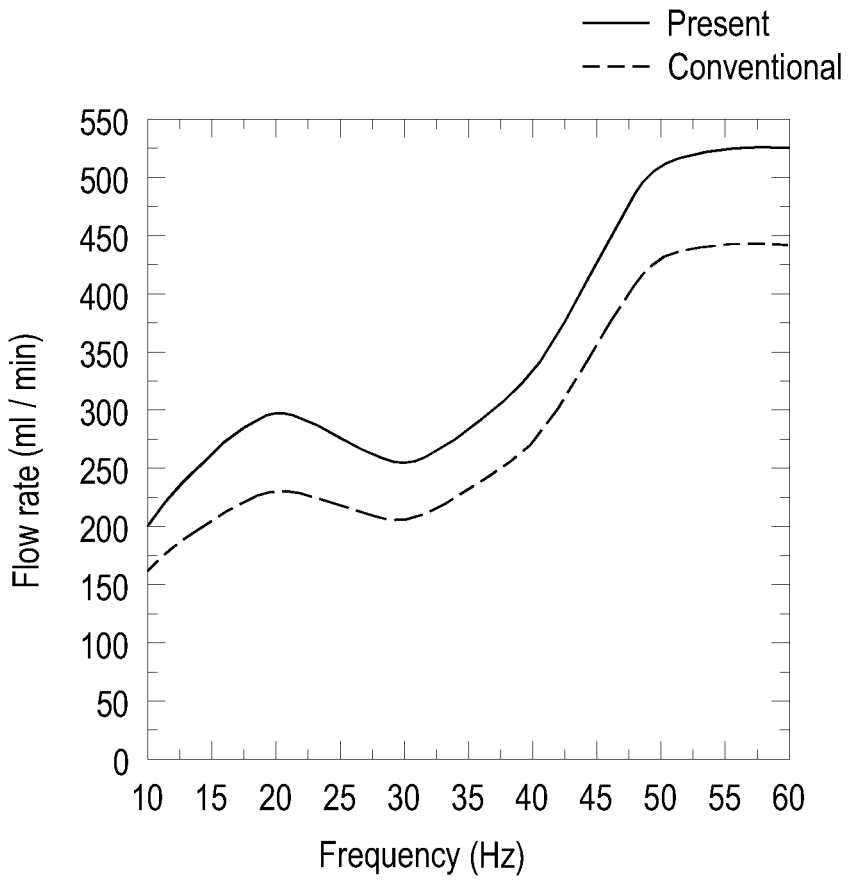
FIG. 6 schematically illustrates the flow rate of the fluid transportation device of the second embodiment with respect to the conventional fluid transportation device.

FIG. 6 schematically illustrates the flow rate of the fluid transportation device of the second embodiment with respect to the conventional fluid transportation device. Due to the sustaining structure 327 within the pressure cavity 326 and the tilt structure 328 of the fluid transportation device 3 of the present invention, the operation of the inlet valve structure 311 is more stable and more regular. Consequently, the fluid can be effectively transported along a shorter path relative to the outlet. Moreover, since the outlet valve channel 323 is conical, a great amount of fluid may be guided to the outlet valve structure 312 and the instantaneous backflow will be reduced. Consequently, the flow rate of the fluid to be transported by the fluid transportation device 3 will be increased. In comparison with the conventional fluid transportation device, the fluid transportation device 3 of the present invention can result in quicker flow rate, higher performance and more stable operation.

From the above description, the fluid transportation device of the present invention has a sustaining structure and a tilt structure. The sustaining structure is disposed within the pressure cavity for limiting an opening direction and an opening degree of the inlet valve structure, thereby guiding the fluid to be transported along a shorter path relative to the outlet. Moreover, since the sustaining structure can limit the moving path of the inlet valve structure, the operation of the inlet valve structure is more stable. Moreover, due to the tilt structure, a pressure cavity with a gradually-increasing depth is defined. The tilt structure and the conical outlet valve channel may facilitate guiding a great amount of fluid toward the outlet valve structure along a short path. Consequently, the flow rate is increased, the instantaneous backflow is reduced, and the performance of the fluid transportation device is enhanced. In views of the above benefits, the fluid transportation device of the present invention is advantageous over the conventional fluid transportation device.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fluid transportation device for transporting a fluid, said fluid transportation device comprising:

a valve seat having an outlet channel and an inlet channel;

a valve cap disposed on said valve seat, and comprising a tilt structure, a sustaining structure, an inlet valve channel and an outlet valve channel, wherein said outlet valve channel is a conical channel for facilitating said fluid to be flowed from said outlet valve channel to said outlet valve structure;

a valve membrane arranged between said valve seat and said valve cap, and having an inlet valve structure and an outlet valve structure, wherein said inlet valve channel and said outlet valve channel are respectively aligned with said inlet valve structure and said outlet valve structure, and a first side of said inlet valve structure is sustained against said sustaining structure; and an actuating module disposed on said valve cap, and comprising a vibration film and an actuator, wherein when said fluid transportation device is in a non-actuation status, said vibration film is separated from said valve cap, so that a pressure cavity with a gradually-increasing depth is defined, wherein when a voltage is applied on said actuator to result in deformation of said actuator, said vibration film connected to said actuator causes a volume change of said pressure cavity, thereby generating a pressure difference to push said fluid, wherein said fluid is introduced into said inlet valve structure through said inlet channel, wherein said sustaining structure is sustained against said first side of said inlet valve structure, so that said inlet valve structure is tilted toward a second side and said fluid is flowed to said pressure cavity through said second side of said inlet valve structure, wherein said fluid is further guided by said tilt structure of said valve cap to be flowed from said pressure cavity to said outlet valve structure, and then flowed out of said outlet channel.

2. The fluid transportation device according to claim 1 wherein said tilt structure is arranged between said inlet valve channel and said outlet valve channel to define said pressure cavity with said gradually-increasing depth, so that a first portion of said pressure cavity near said inlet valve channel is shallower and a second portion of said pressure cavity near said outlet valve channel is deeper.

3. The fluid transportation device according to claim 1 wherein said valve seat and said valve cap have a plurality of recess structures, wherein said fluid transportation device further comprises a plurality of sealing rings, which are accommodated within said recesses and partially protruded from said recess structures so as to provide a pre-force on said valve membrane.

* * * * *